US011130249B2

(12) United States Patent
Neiderer

(10) Patent No.: US 11,130,249 B2
(45) Date of Patent: Sep. 28, 2021

(54) SIDING CUTTING TOOL

(71) Applicant: Abbottstown Industries, Inc., Abbottstown, PA (US)

(72) Inventor: Jeffrey A. Neiderer, Hanover, PA (US)

(73) Assignee: Abbottstown Industries, Inc., Abbottstown, PA (US)

( * ) Notice: Subject to any disclaimer, the term of this patent is extended or adjusted under 35 U.S.C. 154(b) by 0 days.

(21) Appl. No.: 16/529,136

(22) Filed: Aug. 1, 2019

(65) Prior Publication Data

US 2020/0039101 A1 Feb. 6, 2020

Related U.S. Application Data

(60) Provisional application No. 62/714,120, filed on Aug. 3, 2018.

(51) Int. Cl.
*B26B 29/06* (2006.01)

(52) U.S. Cl.
CPC ..... *B26B 29/06* (2013.01)

(58) Field of Classification Search
CPC . B26B 29/06; B26D 7/01; B26D 7/20; H02G 1/1226; H02G 1/1221
See application file for complete search history.

(56) References Cited

U.S. PATENT DOCUMENTS 2,779,325 A * 1/1957 Beckham ..... B28D 1/223 125/23.01
3,279,295 A * 10/1966 Teplitz ..... B23D 35/001 83/601
3,714,856 A * 2/1973 Hall ..... B23D 17/08 83/453
3,986,418 A * 10/1976 Lang ..... B21D 28/32 83/41
4,932,297 A * 6/1990 Borzym ..... B23D 21/00 83/310
5,195,412 A * 3/1993 Flemming ..... B26D 1/60 83/150
5,307,715 A * 5/1994 Smock ..... B21D 28/32 83/386

* cited by examiner

*Primary Examiner* — Ghassem Alie
*Assistant Examiner* — Fernando A Ayala
(74) *Attorney, Agent, or Firm* — Barley Snyder

(57) ABSTRACT

A siding cutting tool comprises an upper plate, a base, a siding support assembly attached to the base and adapted to support a piece of crude siding, and a top notch cutting assembly. The upper plate is movable with respect to the base along a vertical direction. The piece of crude siding has a top lock with a bent or rolled over shape. The top notch cutting assembly includes a top cam plate and a plurality of notch cutters attached to the top cam plate. The top cam plate moves along a top cam plate direction extending at an acute angle with respect to the vertical direction and the notch cutters cut the top lock along the top cam plate direction as the upper plate moves toward the base plate along the vertical direction.

18 Claims, 12 Drawing Sheets

SIDING CUTTING TOOL

CROSS-REFERENCE TO RELATED APPLICATIONS

This application claims the benefit of the filing date of Provisional Patent Application No. 62/714,120 filed on Aug. 3, 2018.

FIELD OF THE INVENTION

The present invention relates to a cutting tool and, more particularly, to a cutting tool for cutting a notch in a piece of siding for a house.

BACKGROUND

A known piece of crude siding 10 is shown in FIG. 1. The crude siding 10 is commonly used in housing applications and is formed of a vinyl material. The crude siding 10 extends along a longitudinal direction L and, along a height direction H perpendicular to the longitudinal direction L, includes a nail hem 12, a top lock 14 extending from the nail hem 12, a face 16 extending from the top lock 14, and a bottom lock 18 at an end of the crude siding 10 opposite the nail helm 12 in the height direction H. The crude siding 10 is formed in a single piece by, for example, molding of the vinyl material. The top lock 14 has a bent or rolled over shape at which the top lock 14 overlaps with the face 16 in a thickness direction T perpendicular to the height direction H and the longitudinal direction L.

The crude siding 10 is positioned to overlap with other pieces of crude siding 10 along the longitudinal direction L and the height direction H to cover an exterior surface in a housing application. Along the height direction H, the bottom lock 18 of an upper piece of crude siding 10 engages with the top lock 14 of a lower piece of crude siding 10. The top lock 14 and bottom lock 18 of the adjacent pieces of crude siding 10, however, would abut one another and prevent overlap along the longitudinal direction L; notches are consequently cut in the nail hem 12, the top lock 14, and the bottom lock 18 at ends of the crude siding 10 to permit the overlap in the longitudinal direction L.

A known siding cutting tool is used to cut the crude siding 10 into pieces of notched siding 20 shown in FIG. 2 to permit the overlap in the longitudinal direction L. As shown in FIG. 2, the known siding cutting tool cuts top notches 22 into the top lock 14 and bottom notches 24 into the bottom lock 18. The known siding cutting tool cuts the top notches 22 by using two cutting motions along the thickness direction T. A first vertical cutting motion along the thickness direction T cuts a portion of the top lock 14 overlapping with the face 16 off from a remainder of the top lock 14, producing a tab 32' as cutting waste 30'. A second vertical cutting motion along the thickness direction T cuts the nail hem 12 and a remainder of the top lock 14 that does not overlap with the face 16. The second vertical cutting motion produces a scrap slug 34' as cutting waste 30', the scrap slug 34' including at least the cut portion of the nail hem 12 and the cut remainder of the top lock 14. As shown in FIG. 2, two pieces of notched siding 20 can be simultaneously cut, producing a tab 32' for each piece of notched siding 20 and a single scrap slug 34' including the cut portions of the nail hems 12, the cut remainders of the top locks 14, and the cut portion of the bottom locks 18 forming the bottom notches 24. The precise shape of the scrap slug 34' would vary for other known shapes of crude siding 10.

The first vertical cutting motion of the known siding cutting tool, however, contacts the face 16, which can bend or otherwise damage the face 16 and impair functionality of the notched siding 20. Further, requiring two vertical cutting motions is time-consuming and produces multiple pieces of cutting waste 30' that exit the known siding cutting tool in different directions.

SUMMARY

A siding cutting tool comprises an upper plate, a base, a siding support assembly attached to the base and adapted to support a piece of crude siding, and a top notch cutting assembly. The upper plate is movable with respect to the base along a vertical direction. The piece of crude siding has a top lock with a bent or rolled over shape. The top notch cutting assembly includes a top cam plate and a plurality of notch cutters attached to the top cam plate. The top cam plate moves along a top cam plate direction extending at an acute angle with respect to the vertical direction and the notch cutters cut the top lock along the top cam plate direction as the upper plate moves toward the base plate along the vertical direction.

BRIEF DESCRIPTION OF THE DRAWINGS

The invention will now be described by way of example with reference to the accompanying figures, of which.

DETAILED DESCRIPTION OF THE EMBODIMENTS

Figure 1:
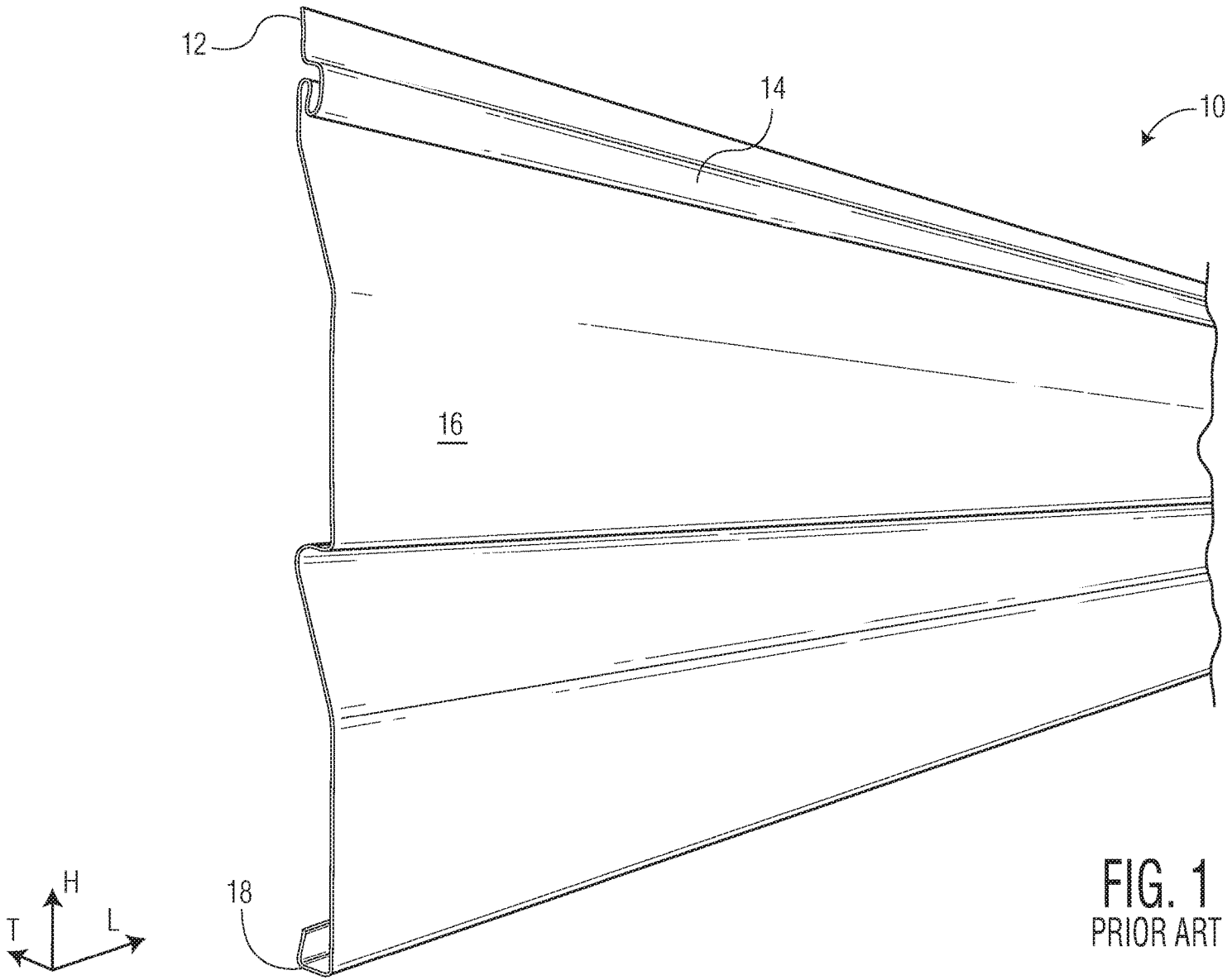
FIG. 1 PRIOR ART
FIG. 1 is a perspective view of a known piece of crude siding.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

A siding cutting tool 1 according to an embodiment of the invention is shown in FIGS. 3-5 and 8A-8D. The siding cutting tool 1 includes a upper plate 100, a base 200, a plurality of cutting guides 300 extending between the upper plate 100 and the base 200, a blade 400 attached to the upper plate 100, a siding support assembly 500 attached to the base 200, a top notch cutting assembly 600, and a bottom notch cutting assembly 700.

Figure 3:
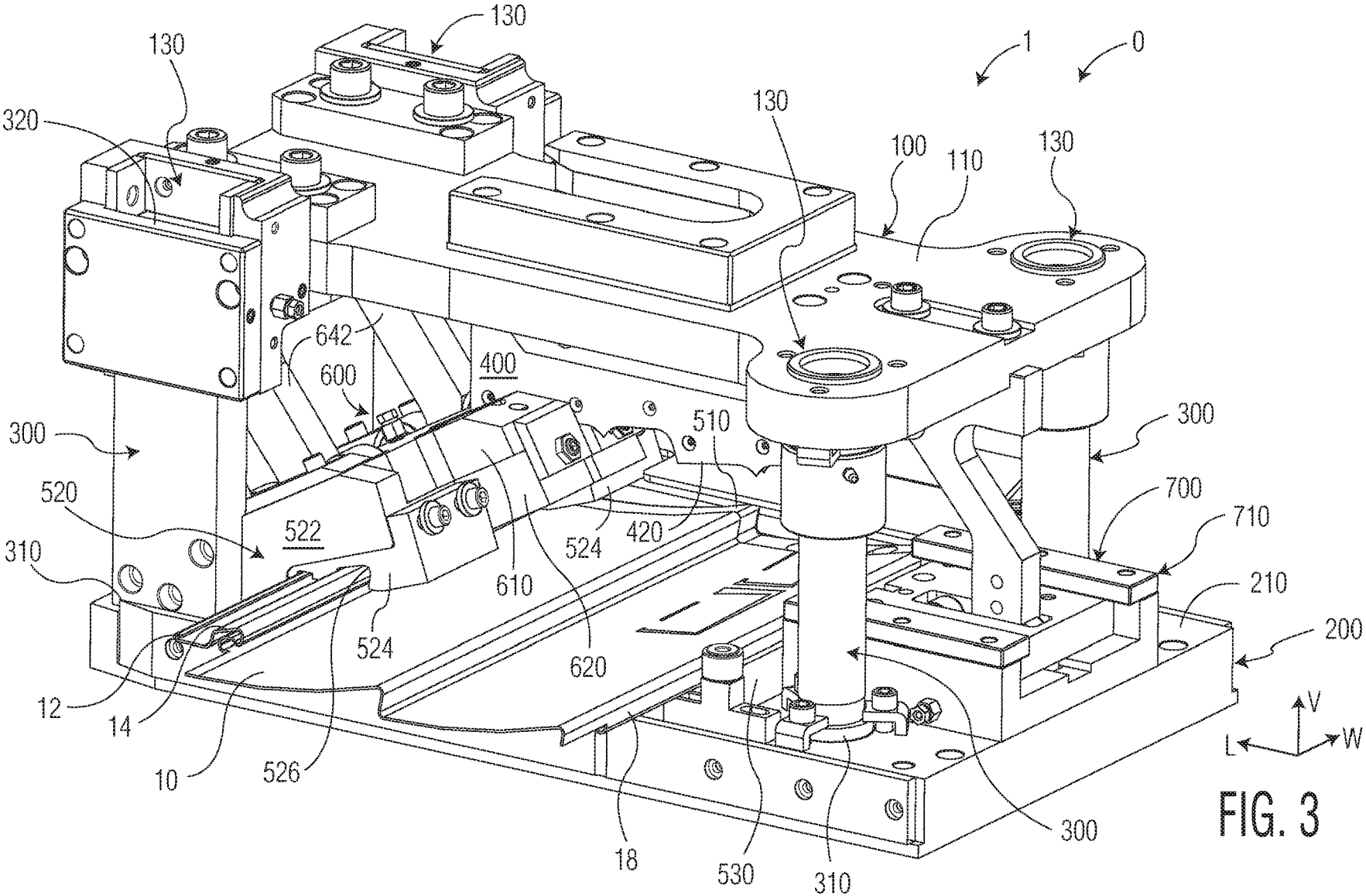
FIG. 3 is a top perspective view of a siding cutting tool according to an embodiment of the invention.
Figure 4:
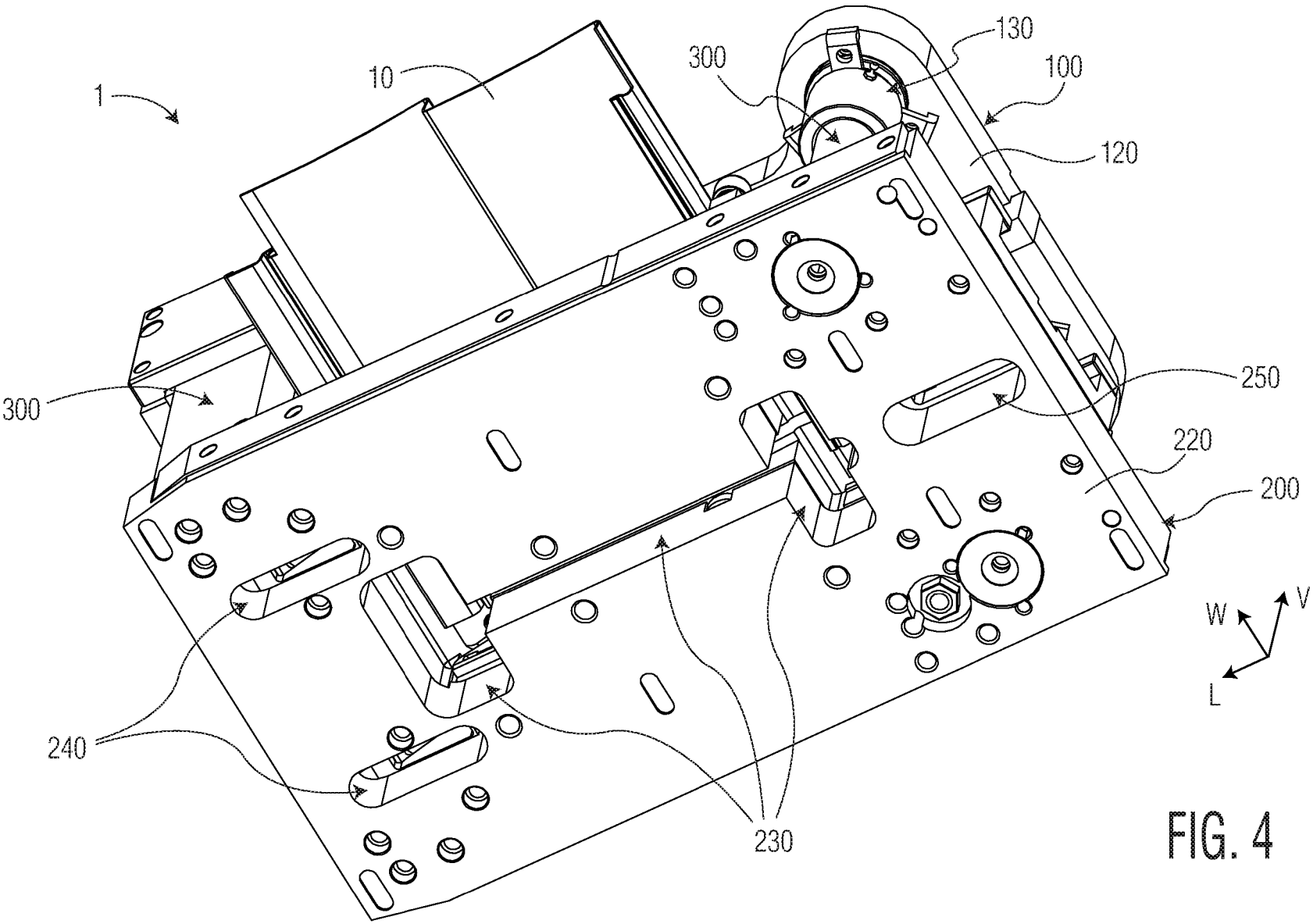
FIG. 4 is a bottom perspective view of the siding cutting tool.

The upper plate 100, as shown in FIGS. 3 and 4, is an approximately planar member having a first side 110, an opposite second side 120, and a plurality of cutting guide passageways 130 extending through the upper plate 100 from the first side 110 to the second side 120.

Figure 5:
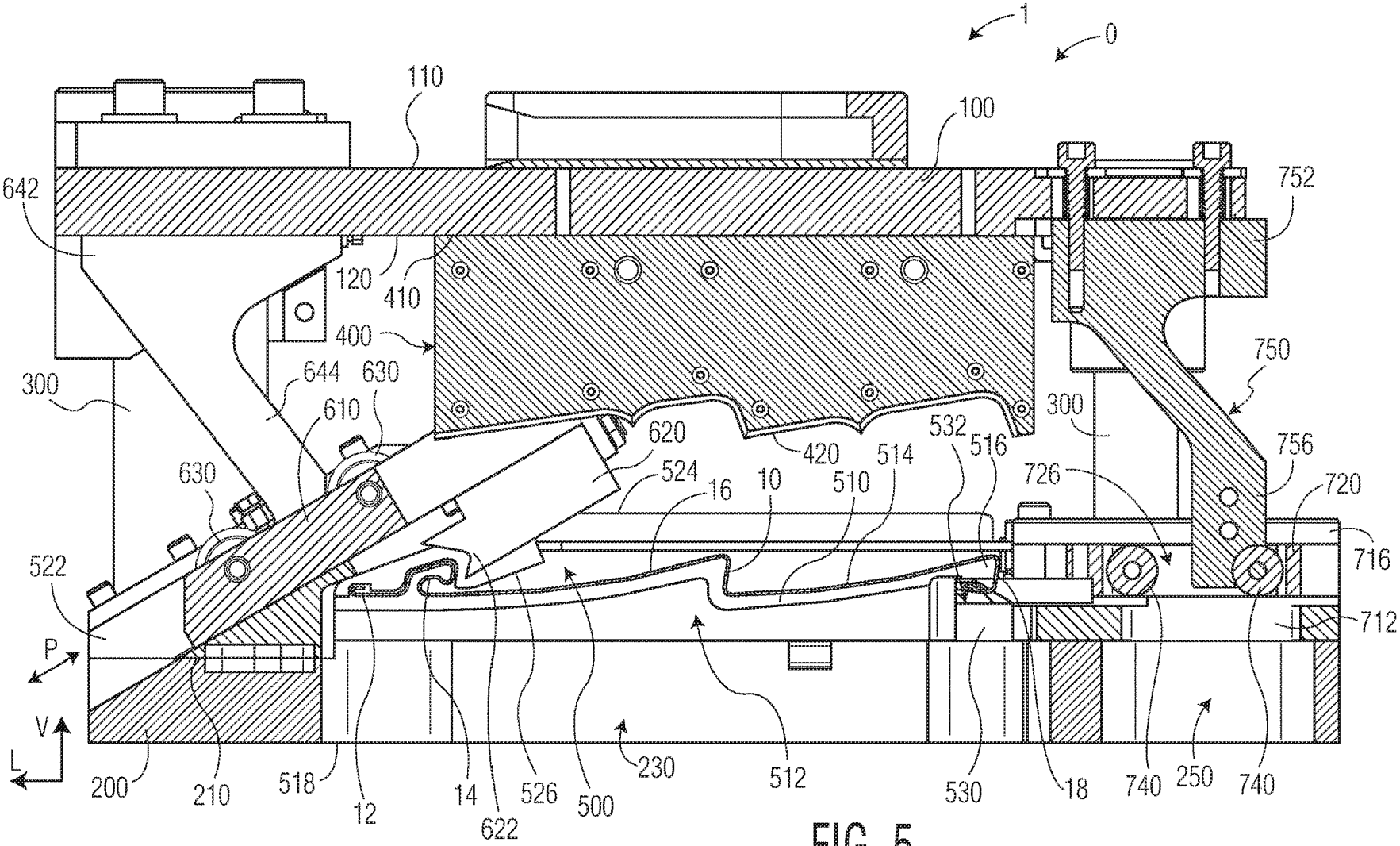
FIG. 5 is a sectional side view of the siding cutting tool.

The base 200, as shown in FIGS. 3-5, is an approximately planar member having a first side 210 and an opposite second side 220. A waste chute 230, a plurality of top cam bar receiving passageways 240, and a bottom cam bar receiving passageway 250 extend through the base 200 from the first side 210 to the second side 220. As shown in FIGS. 4 and 5, the waste chute 230 is disposed approximately centrally in the base 200 in both a longitudinal direction L and a width direction W of the siding cutting tool 1. The top cam bar receiving passageways 240 are disposed adjacent an end of the base 200 opposite from the bottom cam bar receiving passageway 250 in the longitudinal direction L. The longitudinal direction L of the siding cutting tool 1 is perpendicular to the width direction W of the siding cutting tool 1.

As shown in FIGS. 3-5, the upper plate 100 is positioned parallel to the base 200, with the second side 120 of the upper plate 100 facing the first side 210 of the base 200 in a vertical direction V of the siding cutting tool 1. The vertical direction V of the siding cutting tool 1 is perpendicular to both the longitudinal direction L of the siding cutting tool 1 and the width direction W of the siding cutting tool 1.

The upper plate 100 is connected to the base 200 by the plurality of cutting guides 300. As shown in FIGS. 3 and 8A-8D, each of the plurality of cutting guides 300 has a base end 310 attached to the first side 210 of the base 200 and a top end 320 opposite the base end 310. The base end 310 is fixed to the first side 210 of the base 200; the cutting guides 300 are not movable with respect to the base 200. The top end 320 of each of the cutting guides 300 extends in the vertical direction V into one of the cutting guide passageways 130 of the upper plate 100. The upper plate 100 is movable in the vertical direction V along the cutting guides 300 and with respect to the base 200 between the top end 320 and the base end 310.

In the shown embodiment, the upper plate 100 has an approximately rectangular shape and one of the cutting guide passageways 130 extends through the upper plate 100 at approximately each of the four corners of the upper plate 100. Likewise, in the shown embodiment, the base 200 has an approximately rectangular shape and one of the cutting guides 300 is attached at approximately each of the four corners of the base 200 so as to extend into one of the cutting guide passageways 130. In other embodiments, the upper plate 100 and the bottom plate 200 may have different shapes and the location and number of cutting guides 300 may vary provided the upper plate 100 is parallel to the base 200 and is movable along the cutting guides 300 with respect to the base 200.

Further, in the shown embodiment, some of the cutting guides 300 have a cylindrical shape and some of the cutting guides 300 have a rectangular parallelepiped shape. In other embodiments, all of the cutting guides 300 could have a same shape, or the shape of the cutting guides 300 may vary provided the cutting guides 300 are attached to the base 200 and extend through the cutting guide passageways 130 of the upper plate 100.

The blade 400, as shown in FIGS. 3, 5, and 8A-8D, has a flat side 410 attached to the second side 120 of the upper plate 100 and a contoured side 420 opposite the flat side 410. The blade 400 extends from the flat side 410 to the contoured side 420 along the vertical direction V. The blade 400 is disposed approximately centrally on the second side 120 of the upper plate 100 in both the longitudinal direction L and the width direction W; the blade 400 may be attached to the upper plate 100 by welding or any fastener known to those with ordinary skill in the art. The contoured side 420 comes to a point in the vertical direction V to form a cutting edge extending along the longitudinal direction L.

The contoured side 420 has a contoured shape adapted to a particular type of crude siding 10 to be cut by the siding cutting tool 1. In the shown embodiment, the contoured shape of the contoured side 420 is adapted to cut the crude siding 10 having the shape shown in FIG. 1. In other embodiments, the contoured shape of the contoured side 420 may be different to cut pieces of crude siding 10 having other shapes.

The siding support assembly 500 is attached to the first side 210 of the base 200 and, as shown in FIGS. 3 and 5, includes a shear plate 510, a pair of anvils 520, and a pair of support blocks 530.

The shear plate 510, as shown in FIGS. 3 and 5, has a shear plate passageway 512 extending through the shear plate 510 in the vertical direction V and a shear plate contoured surface 514 on a side of shear plate 510 opposite the base 200 in the vertical direction V. The shear plate passageway 512 extends in longitudinal direction L, is positioned approximately centrally in the shear plate 510 in the width direction W, and has a width in the width direction W approximately equal to a width of the blade 400 in the width direction W. The shear plate contoured surface 514 has a contoured shape adapted to match the shape of the crude siding 10 to be cut by the siding cutting tool 1. In the shown embodiment, the contoured shape of the shear plate contoured surface 514 is adapted cut the crude siding 10 shape shown in FIG. 1. In other embodiments, the contoured shape of the contoured surface 514 may be different to cut pieces of crude siding 10 having other shapes.

As shown in FIG. 5, the shear plate 510 has a bottom end 516 and a top end 518 opposite the bottom end 516 in the longitudinal direction L. The bottom end 516 is shaped to fit the bottom lock 18 of the crude siding 10.

Each of the anvils 520, as shown in FIGS. 3 and 5, has an anvil base 522 and a cantilevered anvil portion 524 attached to the anvil base 522. The anvil base 522 is attached to the first side 210 of the base 200 adjacent the top end 518 of the shear plate 510. The cantilevered anvil portion 524 extends from the anvil base 522 over the top end 518 of the shear plate 510. A surface of the cantilevered anvil portion 524 facing the top end 518 of the shear plate 510 has an anvil contoured surface 526; the anvil contoured surface 526 has a shape adapted to match a shape of the nail hem 12 and the top lock 14 of the crude siding 10. The anvils 520 are spaced apart along with direction W.

The pair of support blocks 530, as shown in FIGS. 3 and 5, are attached to the first side 210 of the base 200 under the bottom end 516 of the shear plate 510 in the vertical direction V. The pair of support blocks 530 are spaced apart along the width direction W by a support block passageway 532.

Figure 6:
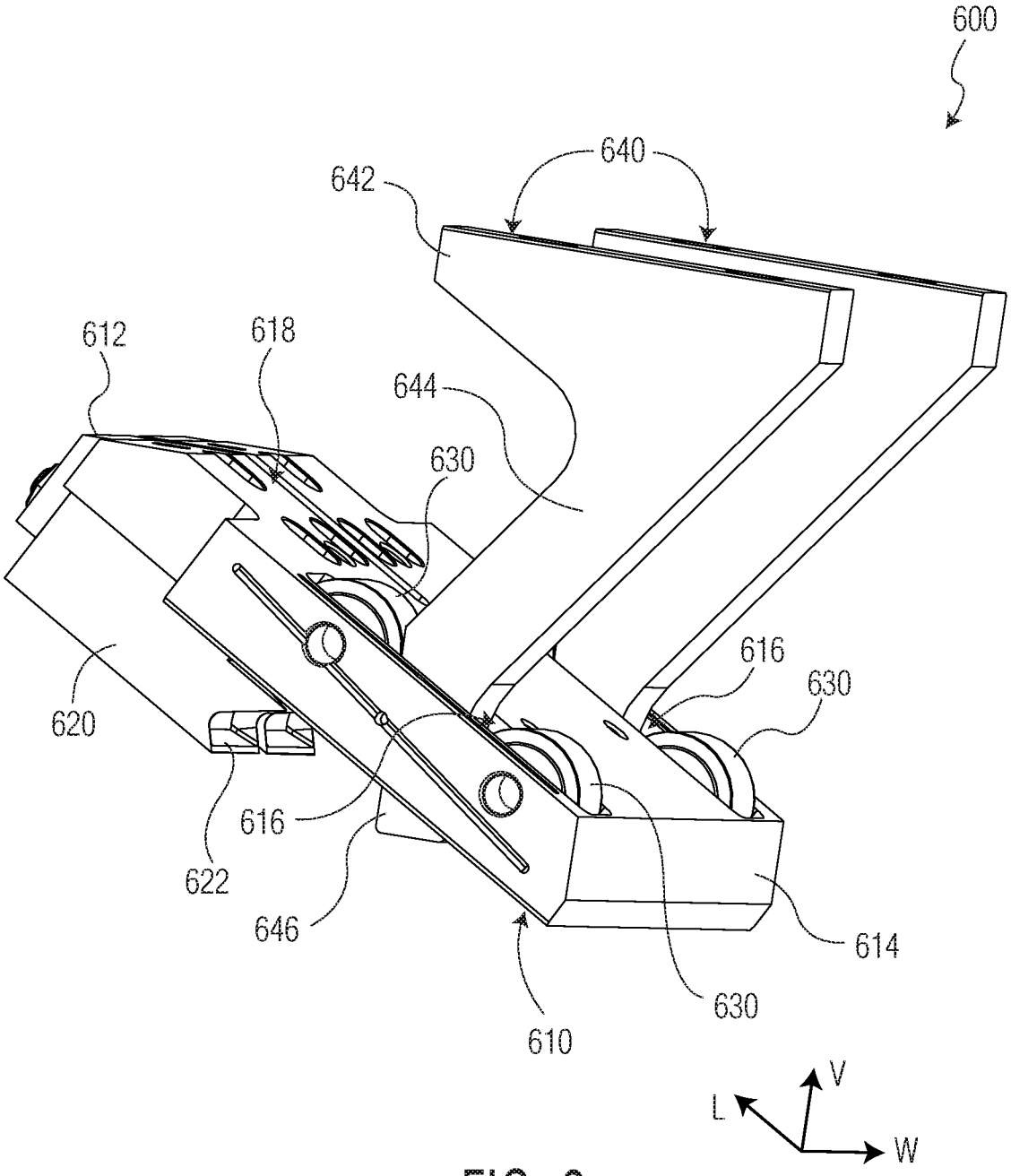
FIG. 6 is a perspective view of a top notch cutting assembly of the siding cutting tool.

The top notch cutting assembly 600, as shown in FIGS. 3, 5, and 6, includes a top cam plate 610, a plurality of notch cutters 620 attached to the top cam plate 610, a plurality of top rollers 630 disposed in the top cam plate 610, and a plurality of top cam bars 640 extending through the top cam plate 610.

The top cam plate 610, as shown in FIG. 6, has a first end 612, a second end 614, and a pair of top cam plate passageways 616 extending through the top cam plate 610. As shown in FIGS. 3 and 5, in the siding cutting tool 1, the top cam plate 610 is disposed such that a direction extending between the first end 612 and the second end 614 is at an angle with respect to the upper plate 100 and the base 200. As shown in FIG. 6, the top cam plate 610 has a blade passageway 618 disposed at the first end 612 and extending through the top cam plate 610 in the vertical direction V.

The plurality of notch cutters 620, as shown FIGS. 3, 5, and 6, are attached to the first end 612 of the top cam plate 610. Each of the notch cutters 620 has a notch cutting end 622 positioned approximately centrally along the top cam plate 610 and facing the second end 614 of the top cam plate 610. The notch cutting end 622 is adapted to cut a piece of siding.

The plurality of top rollers 630 are disposed in the top cam plate passageways 616, as shown in FIG. 6. In each top cam plate passageway 616, each of the top rollers 630 is attached to the top cam plate 610 such that the top rollers 630 can rotate within the top cam plate passageway 616. In each top cam plate passageway 616, the plurality of top rollers 630 are spaced apart. In the shown embodiment, the top cam plate 610 has two top cam plate passageways 616 and two top rollers 630 are disposed in each top cam plate passageway 616. In another embodiment, the top cam plate 610 may only have one top cam plate passageway 616 having two top rollers 630 disposed therein.

As shown in FIGS. 3 and 5, the top cam plate 610 is positioned between the anvils 520 and is held in the width direction W and at an angle with respect to the vertical direction V by the anvils 520. The top rollers 630 abut the anvil bases 522 and the top cam plate 610, with the notch cutters 620 attached, can move with respect to the anvils 520 along a top cam plate direction P shown in FIG. 5, as described in greater detail below. During movement along the top cam plate direction P, the notch cutters 620 are positioned between the cantilevered anvil portions 524.

The plurality of top cam bars 640, as shown in FIGS. 3, 5, and 6, are each integrally formed with an upper section 642, a central section 644, and a lower section 646. The upper section 642 is attached to the second side 120 of the upper plate 100. The central section 644 extends from the upper section 642 at an angle with respect to the vertical direction V and at an angle with respect to the upper plate 100 and the base 200. The lower section 646 extends from the central section 644 in the vertical direction V and perpendicular to the upper plate 100 and the base 200.

The plurality of top cam bars 640, as shown in FIGS. 3, 5, and 6, are each positioned to extend through one of the top cam plate passageways 616 between the top rollers 630. The top cam bars 640 contact the top rollers 630 in each top cam plate passageway 616. The plurality of top cam bars 640, as described in greater detail below, are movable with respect to the top cam plate 610 and correspondingly impart movement to the top cam plate 610. In another embodiment, the top notch cutting assembly 600 only includes one top cam bar 640 extending through one top cam plate passageway 616 of the top cam plate 610.

Figure 7:
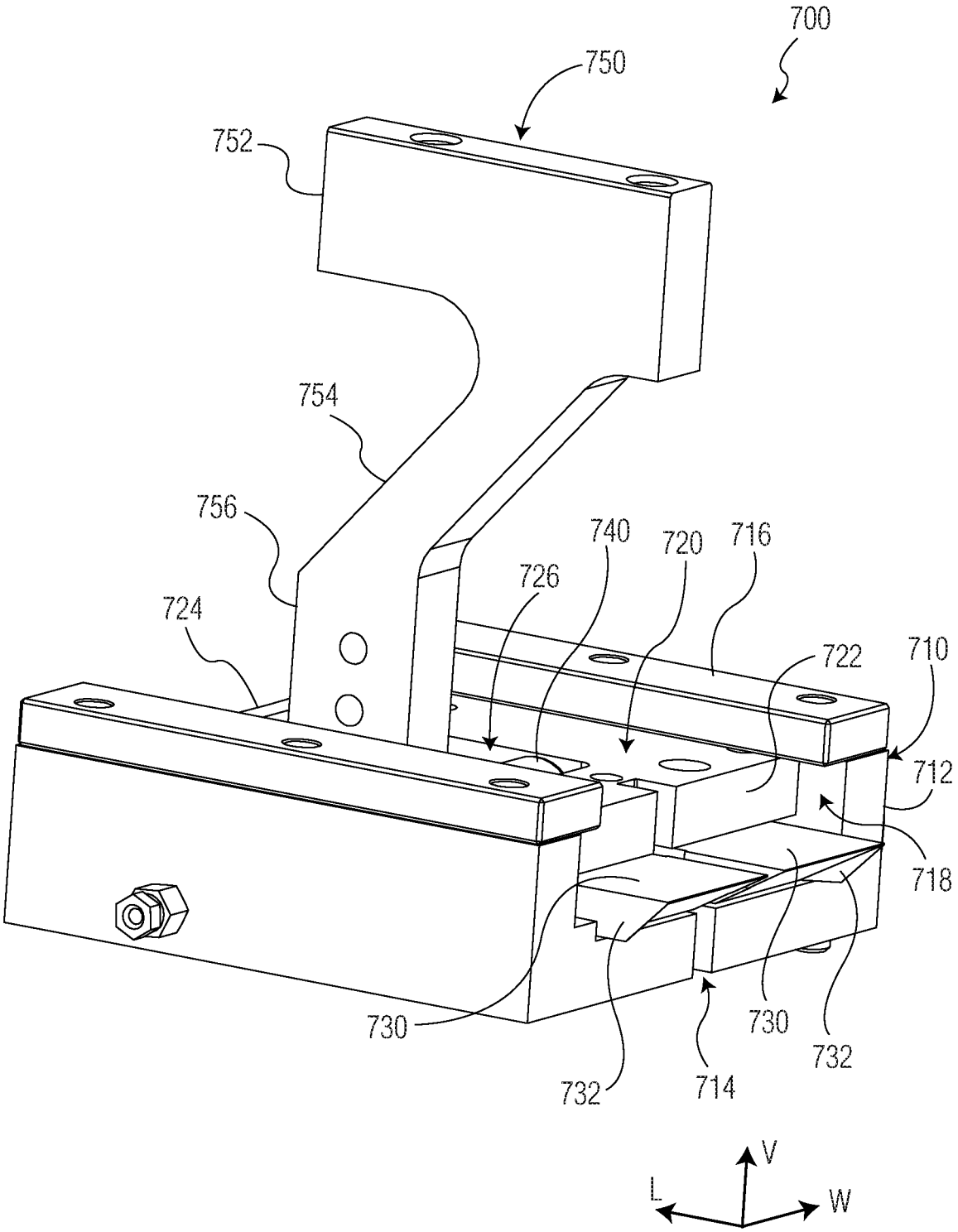
FIG. 7 is a perspective view of a bottom notch cutting assembly of the siding cutting tool.

The bottom notch cutting assembly 700, as shown in FIGS. 3, 5, and 7, includes a bottom cam housing 710, a bottom cam plate 720 movable within the bottom cam housing 710, a plurality of bottom cutters 730 attached to the bottom cam plate 720, a plurality of bottom rollers 740 disposed in the bottom cam plate 720, and a bottom cam bar 750 extending through the bottom cam plate 720.

The bottom cam housing 710, as shown in FIG. 7, includes a cam base 712 and a plurality of cam retainers 716 attached to the cam base 712 to define a cam plate passageway 718. The cam base 712 has an approximate U-shape and the cam retainers 716 are attached to a top of the cam base 712 in the vertical direction V. The cam retainers 716 overlap an open portion of the U-shaped cam base 712 in the vertical direction V to define the cam plate passageway 718 extending along the longitudinal direction L. As shown in FIG. 7, the cam base 712 has a blade passageway 714 extending through a bottom of the U-shaped cam base 712 in the vertical direction V.

The bottom cam plate 720, as shown in FIGS. 5 and 7, has a first end 722, a second end 724, and a bottom cam plate passageway 726 extending through the bottom cam plate 720. The bottom cam plate passageway 726 extends through an approximate center of the bottom cam plate 720 in the longitudinal direction L and the width direction W.

The plurality of bottom cutters 730, as shown in FIGS. 5 and 7, are attached to the first end 722 of the bottom cam plate 720. Each of the bottom cutters 730 extends out from a side of the bottom cam plate 720 in the longitudinal direction L and has a bottom cutting end 732 distal from the bottom cam plate 720. The bottom cutting end 732 is adapted to cut the piece of siding.

The plurality of bottom rollers 740 are disposed in the bottom cam plate passageway 726, as shown in FIGS. 5 and 7. Each of the bottom rollers 740 is attached to the bottom cam plate 720 such that the bottom rollers 740 can rotate within the bottom cam plate passageway 726. The bottom rollers 740 are spaced apart within the bottom cam plate passageway 726.

The bottom cam bar 750, as shown in FIGS. 5 and 7, is integrally formed with an upper section 752, a central section 754, and a lower section 756. The upper section 752 is attached to the second side 120 of the upper plate 100. The central section 754 extends from the upper section 752 at an angle with respect to the vertical direction V and at an angle with respect to the upper plate 100 and base 200. The lower section 756 extends from the central section 754 in the vertical direction V and perpendicular to the upper plate 100 and the base 200.

As shown in FIGS. 3, 5, and 7, the cam base 712 is attached to the first side 210 of the base 200. The bottom cam plate 720 is positioned in the cam plate passageway 718 of the bottom cam housing 710. The bottom rollers 740 abut the cam base 712 and, with the bottom cutters 730 attached, the bottom cam plate 720 is movable in the cam plate passageway 718 along the longitudinal direction L. The bottom cam bar 750 is positioned to extend through the bottom cam plate passageway 726 between the bottom rollers 740 and contacts the bottom rollers 740. The bottom cam bar 750, as described in greater detail below, is movable with respect to the bottom cam plate 720 and correspondingly impart movement to the bottom cam plate 720.

The usage of the siding cutting tool 1 to cut a piece of crude siding 10 into a piece of notched siding 20 will now be described in greater detail with reference to FIGS. 3, 5, 8A-8D, and 9.

Figure 8A:
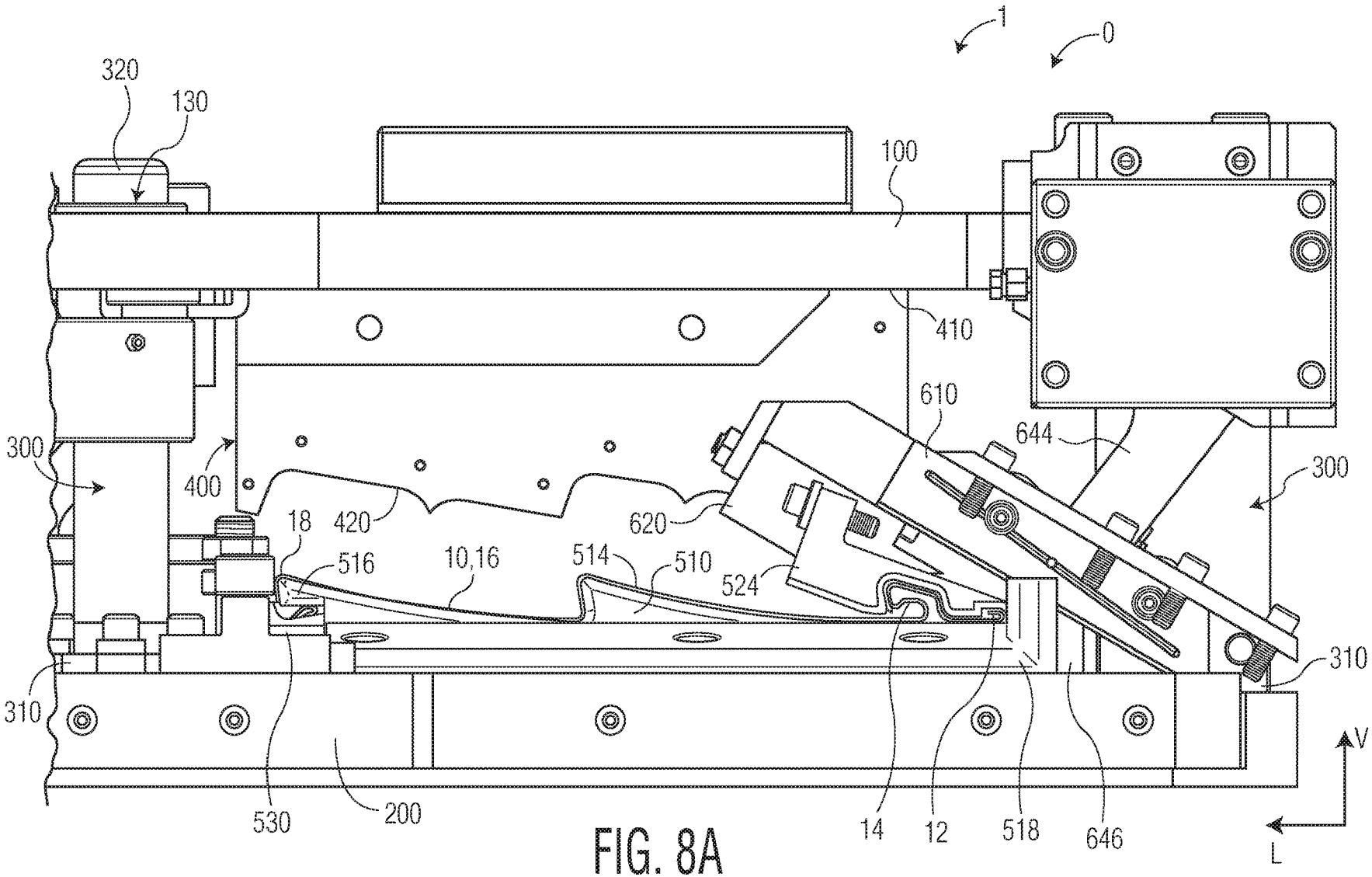
FIG. 8A is a side view of the siding cutting tool in an open position.
Figure 8B:
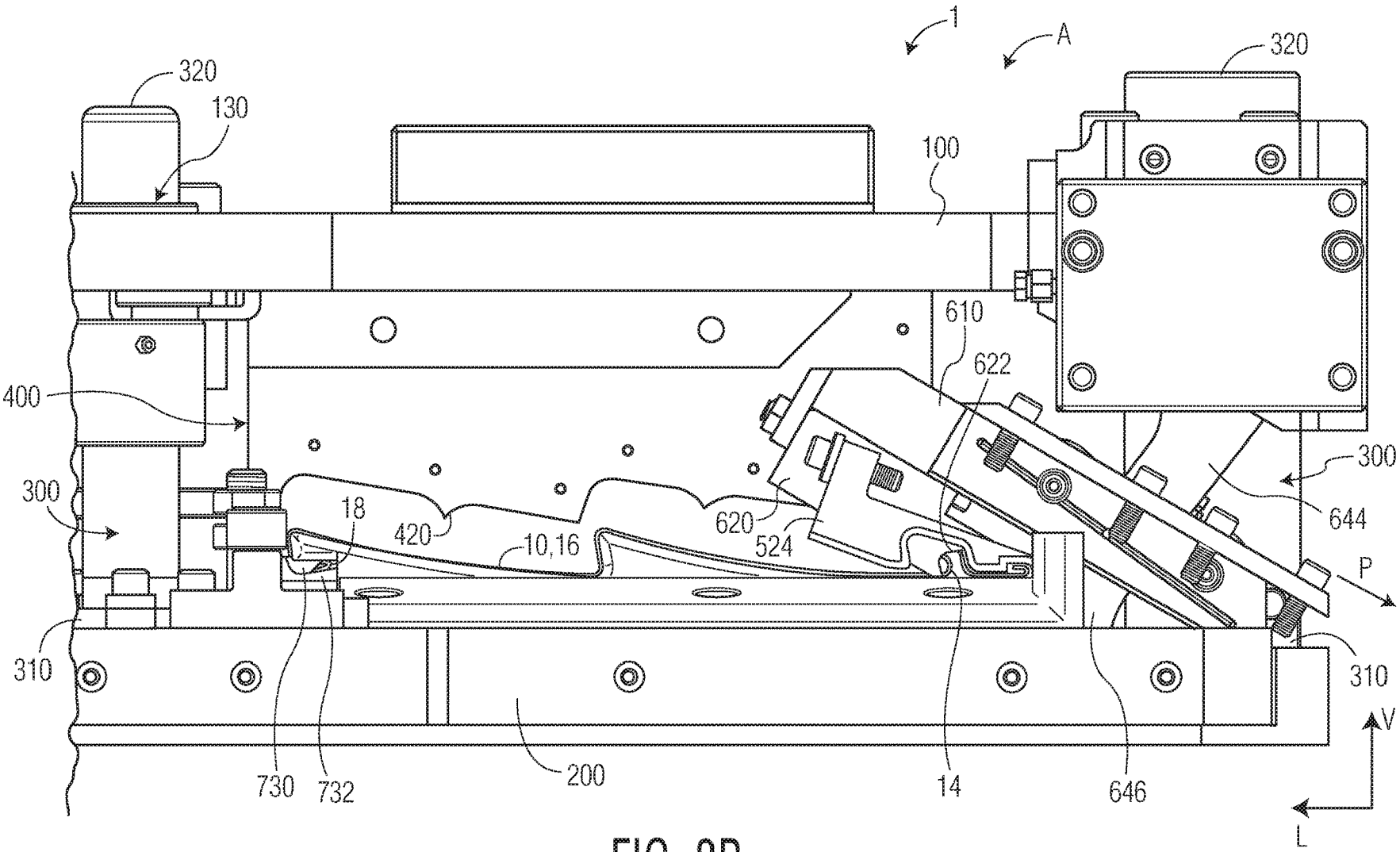
FIG. 8B is a side view of the siding cutting tool in a first intermediate position.
Figure 8C:
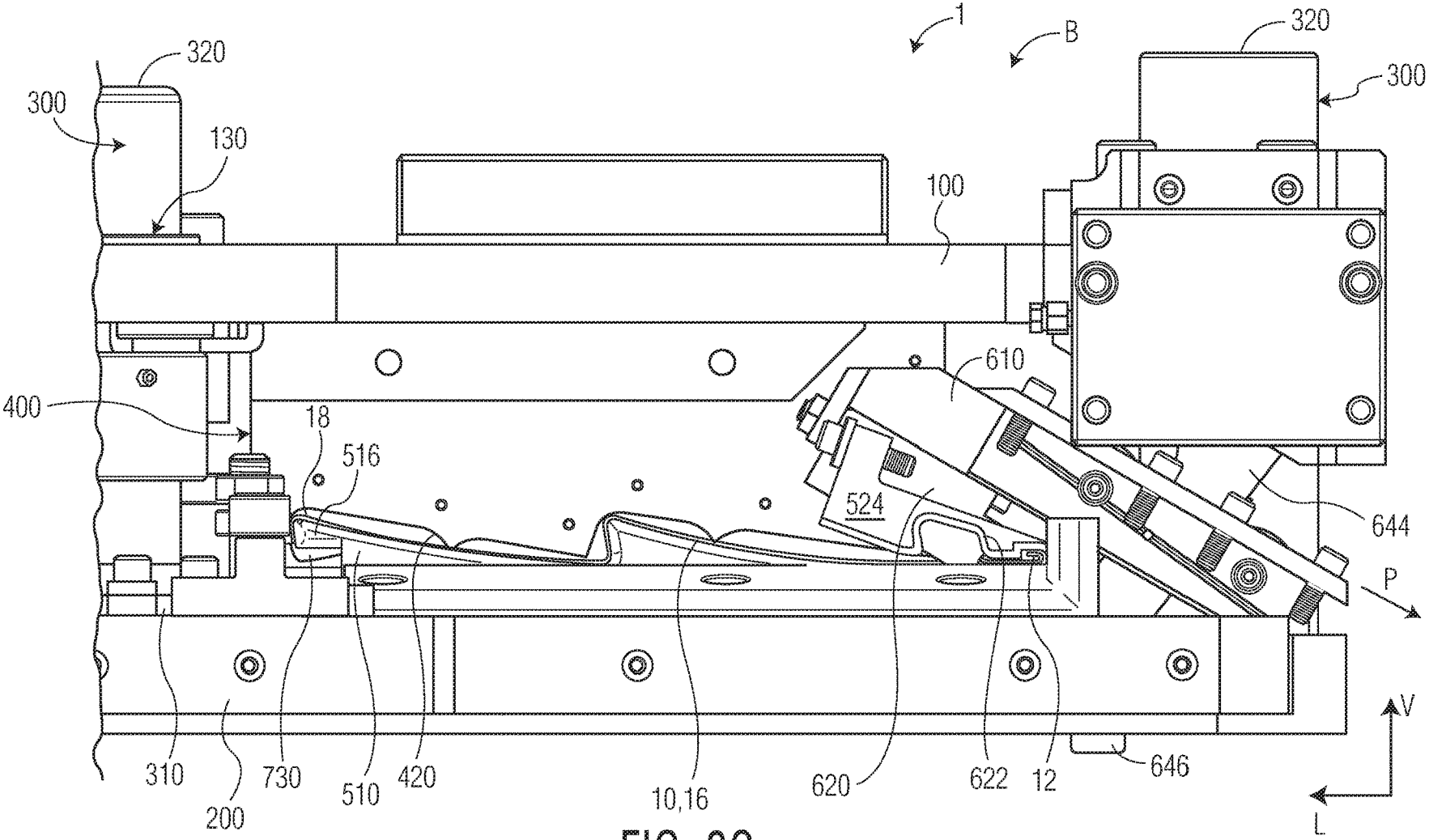
FIG. 8C is a side view of the siding cutting tool in a second intermediate position.
Figure 8D:
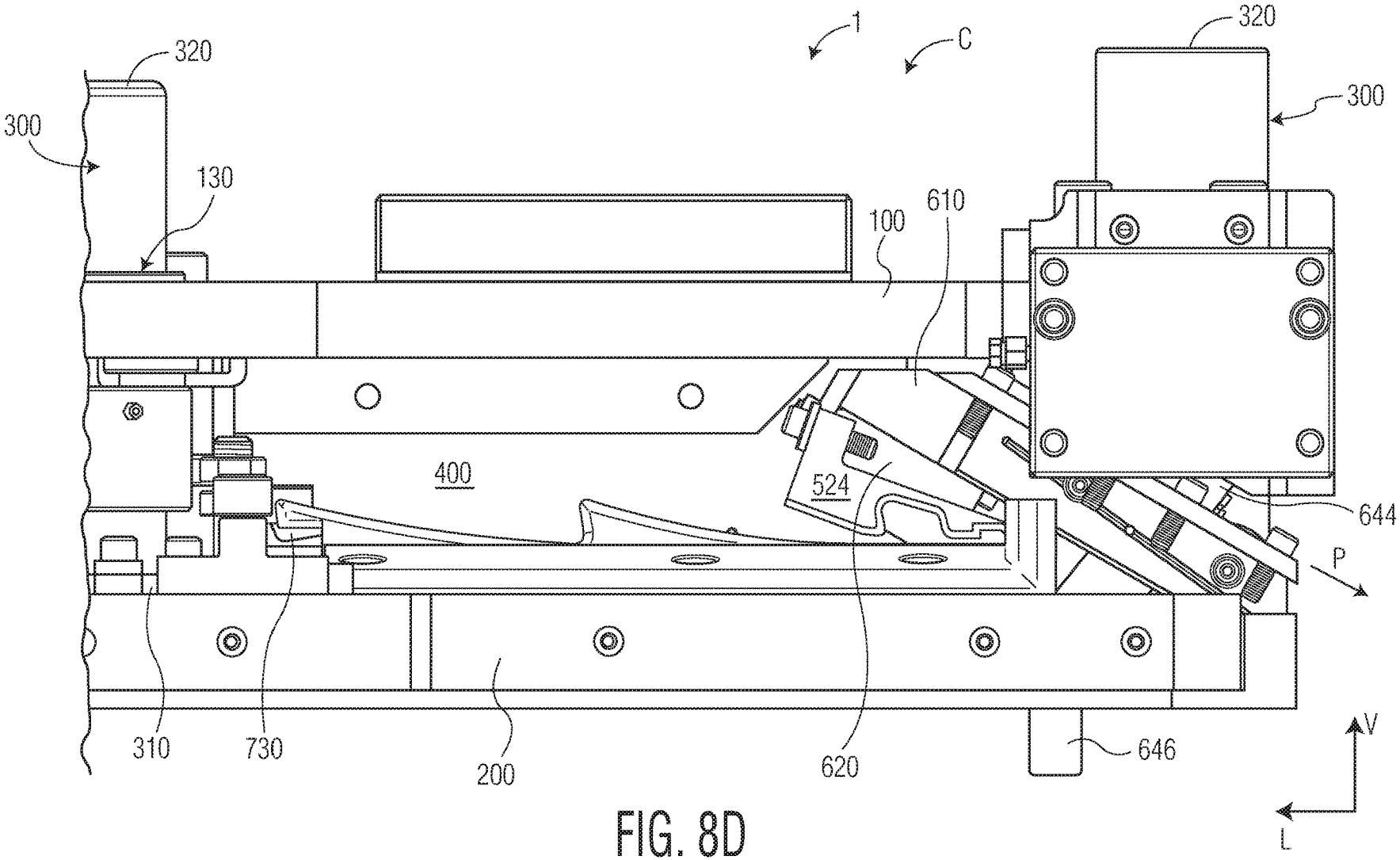
FIG. 8D is a side view of the siding cutting tool in a closed position.

The siding cutting tool 1 is movable between an open position O shown in FIGS. 3, 5, and 8A, and a closed position C shown in FIG. 8D. The siding cutting tool 1 may move between the open position O and the closed position C by a motor, manually, or by any other method of providing the force necessary to move the siding cutting tool 1 between the open position O in the closed position C known to those of ordinary skill in the art.

As shown in FIGS. 3, 5, and 8A, with the siding cutting tool 1 in the open position O, the crude siding 10 is inserted into the siding cutting tool 1. The nail hem 12 and the top lock 14 are inserted between the cantilevered anvil portions 524 and the top end 518 of the shear plate 510. The anvil contoured surface 526 of the cantilevered anvil portion 524 matches a shape of the nail hem 12 and the top lock 14. The face 16 of the crude siding 10 is positioned on the shear plate 510 and the shear plate contoured surface 514 matches a contour of the face 16. The bottom lock 18 extends around the bottom end 516 of the shear plate 510 and is partially held between the bottom end 516 of the shear plate 510 and the support blocks 530. The bottom end 516 of the shear plate 510 has a shape matching the bottom lock 18. The crude siding 10 is then slid along the width direction W to be fully inserted into the siding cutting tool 1.

The siding cutting tool 1, as shown in FIGS. 8A-8D, is moved in the vertical direction V from the open position O to the closed position C after the crude siding 10 is inserted into the siding cutting tool 1. For the purposes of illustration, the siding cutting tool 1 is shown in the open position O in FIG. 8A, in a first intermediate position A in FIG. 8B, in a second intermediate position B in FIG. 8C, and in the closed position C in FIG. 8D. The upper plate 100 moves in the vertical direction V along the cutting guides 300 from the open position O to the closed position C. Correspondingly, the blade 400, the top cam bar 640, and the bottom cam bar 750 attached to the upper plate 100 also move in the vertical direction V as the upper plate 100 moves in the vertical direction V.

In the open position O shown in FIGS. 5 and 8A, the lower sections 646 of the top cam bars 640 are positioned between the top rollers 630 in the top cam plate passageways 616. Likewise, the lower section 756 of the bottom cam bar 750 is positioned between the bottom rollers 740 in the bottom cam plate passageway 726. The contoured side 420 of the blade 400 is entirely spaced apart from the crude siding 10 in the open position O.

As the upper plate 100 moves in the vertical direction V from the open position O to the first intermediate position A shown in FIG. 8B, the lower sections 646 of the top cam bars 640 move into the top cam bar receiving passageways 240 of the base 200 shown in FIG. 4 and the central sections 644 of the top cam bars 640 move between the top rollers 630. Because the central sections 644 are disposed at an angle with respect to the lower sections 646, the contact between the central sections 644 and the top rollers 630 moves the top cam plate 610 in the top cam plate direction P shown in FIG. 8B. The movement of the top cam plate 610 in the top cam plate direction P moves the notch cutting ends 622 of the notch cutters 620 into contact with the top lock 14 of the crude siding 10. In the first intermediate position A shown in FIG. 8B, the notch cutting ends 622 of the notch cutters 620 have partially cut through the top lock 14 at an acute angle of the top cam plate direction P with respect to the vertical direction V.

As the upper plate 100 moves in the vertical direction V from the open position O to the first intermediate position A, the lower section 756 of the bottom cam bar 750 moves into the bottom cam bar receiving passageway 250 of the base 200 shown in FIG. 4 and the central section 754 of the bottom cam bar 750 moves between the bottom rollers 740. Because the central section 754 is disposed at an angle with respect to the lower section 756, the contact between the central section 754 and the bottom rollers 740 moves the bottom cam plate 720 within the cam plate passageway 718 in the longitudinal direction L. The movement of the bottom cam plate 720 in the longitudinal direction L moves the bottom cutting end 732 of the bottom cutters 730 into contact with the bottom lock 18 of the crude siding 10. In the first intermediate position A shown in FIG. 8B, the bottom cutting ends 732 of the bottom cutters 730 have partially cut through a portion of the bottom lock 18 in the longitudinal direction L.

The contoured side 420 of the blade 400 is still entirely spaced apart from the crude siding 10 in the first intermediate position A as shown in FIG. 8B. The blade 400 passes through the blade passageway 618 of the top cam plate 610 and the blade passageway 714 of the bottom cam housing 710 as the blade 400 moves in the vertical direction V.

As the upper plate 100 moves in the vertical direction V from the first intermediate position A to the second intermediate position B shown in FIG. 8C, the central sections 644 of the top cam bars 640 continue to move in the vertical direction V between the top rollers 630 and correspondingly continue to move the top cam plate 610 in the top cam plate direction P. In the second intermediate position B shown in FIG. 8C, the notch cutting ends 622 of the notch cutters 620 have completely cut through the top lock 14 at the angle of the top cam plate direction P with respect to the vertical direction V. The notch cutting ends 622 of the notch cutters 620 do not contact the face 16 of the crude siding 10. In the second intermediate position B, the notch cutting ends 622 have not yet cut through the nail hem 12.

As the upper plate 100 moves in the vertical direction V from the first intermediate position A to the second intermediate position B shown in FIG. 8C, the central section 754 of the bottom cam bar 750 continues to move in the vertical direction V between the bottom rollers 740 and correspondingly continues to move the bottom cam plate 720 in the longitudinal direction L. In the second intermediate position B shown in FIG. 8C, the bottom cutting ends 732 of the bottom cutters 730 have completely cut through the portion of the bottom lock 18 disposed under the bottom end 516 of the shear plate 510. Portions of the contoured side 420 of the blade 400 come into contact with portions of the crude siding 10 in the second intermediate position B.

As the upper plate 100 moves in the vertical direction V from the second intermediate position B to the closed position C shown in FIG. 8D, the central sections 644 of the top cam bars 640 continue to move in the vertical direction V between the top rollers 630 and correspondingly continue to move the top cam plate 610 in the top cam plate direction P. In the closed position C shown in FIG. 8D, the notch cutting ends 622 of the notch cutters 620 have completely cut through the top lock 14 and the nail hem 12 at the angle of the top cam plate direction P with respect to the vertical direction V. The top cam plate 610 is at a furthest position in the top cam plate direction P in the closed position C.

As the upper plate 100 moves in the vertical direction V from the second intermediate position B to the closed position C shown in FIG. 8D, the blade 400 continues to move in the vertical direction V and the contoured side 420 cuts through the crude siding 10. The contoured side 420 of the blade 400 extends into the shear plate passageway 512 to fully cut through the crude siding 10 from the nail hem 12 to the bottom lock 18.

When the siding cutting tool 1 reaches the closed position C, and the crude siding 10 is completely cut through to become the notched siding 20, the siding cutting tool 1 is moved back to the open position O. The notched siding 20 shown in FIG. 9 can then be removed from the siding cutting tool 1.

Figure 2:
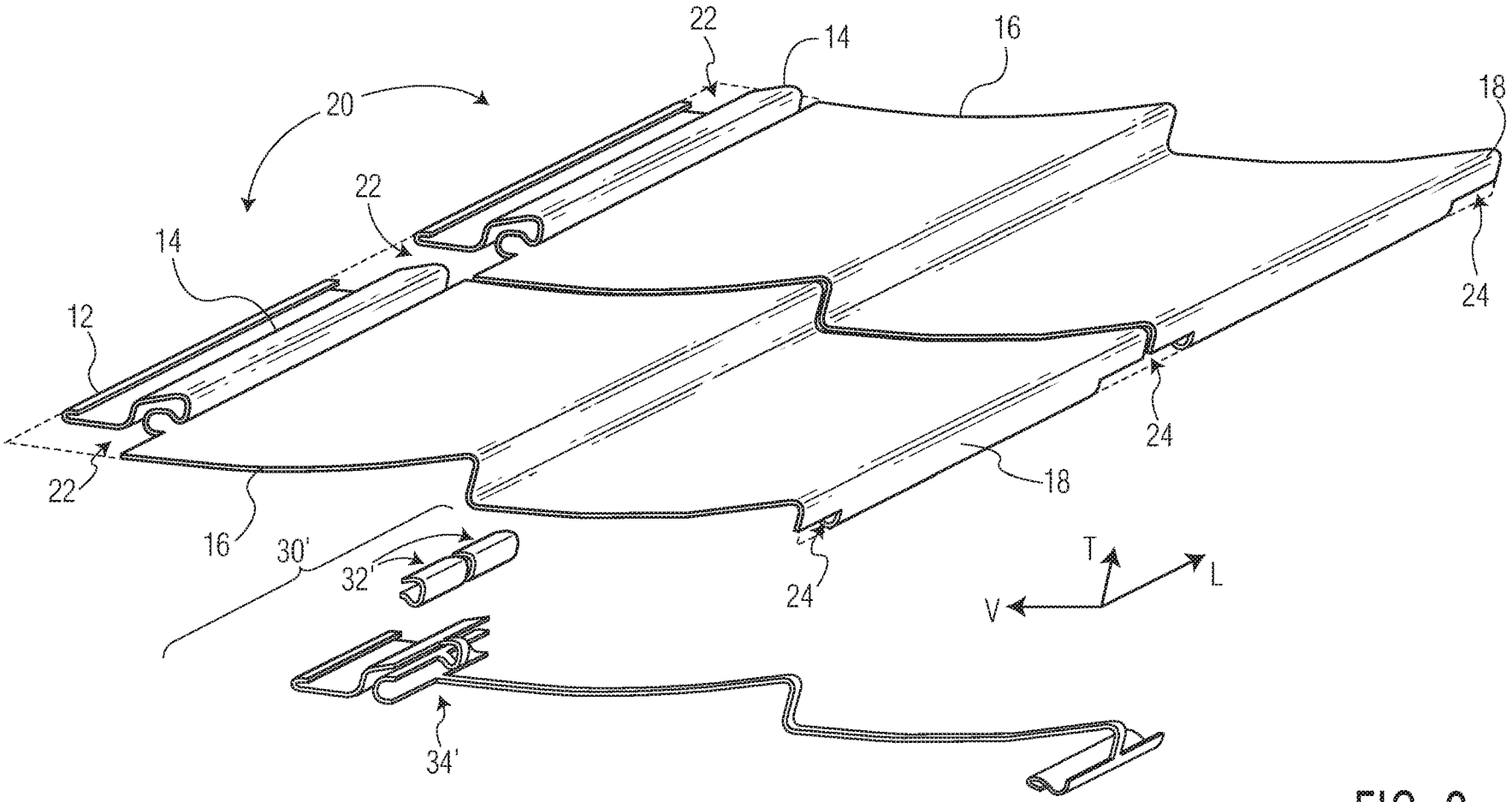
FIG. 2 PRIOR ART
FIG. 2 is a perspective view of a piece of notched siding with a cutting waste according to the prior art.
Figure 9:
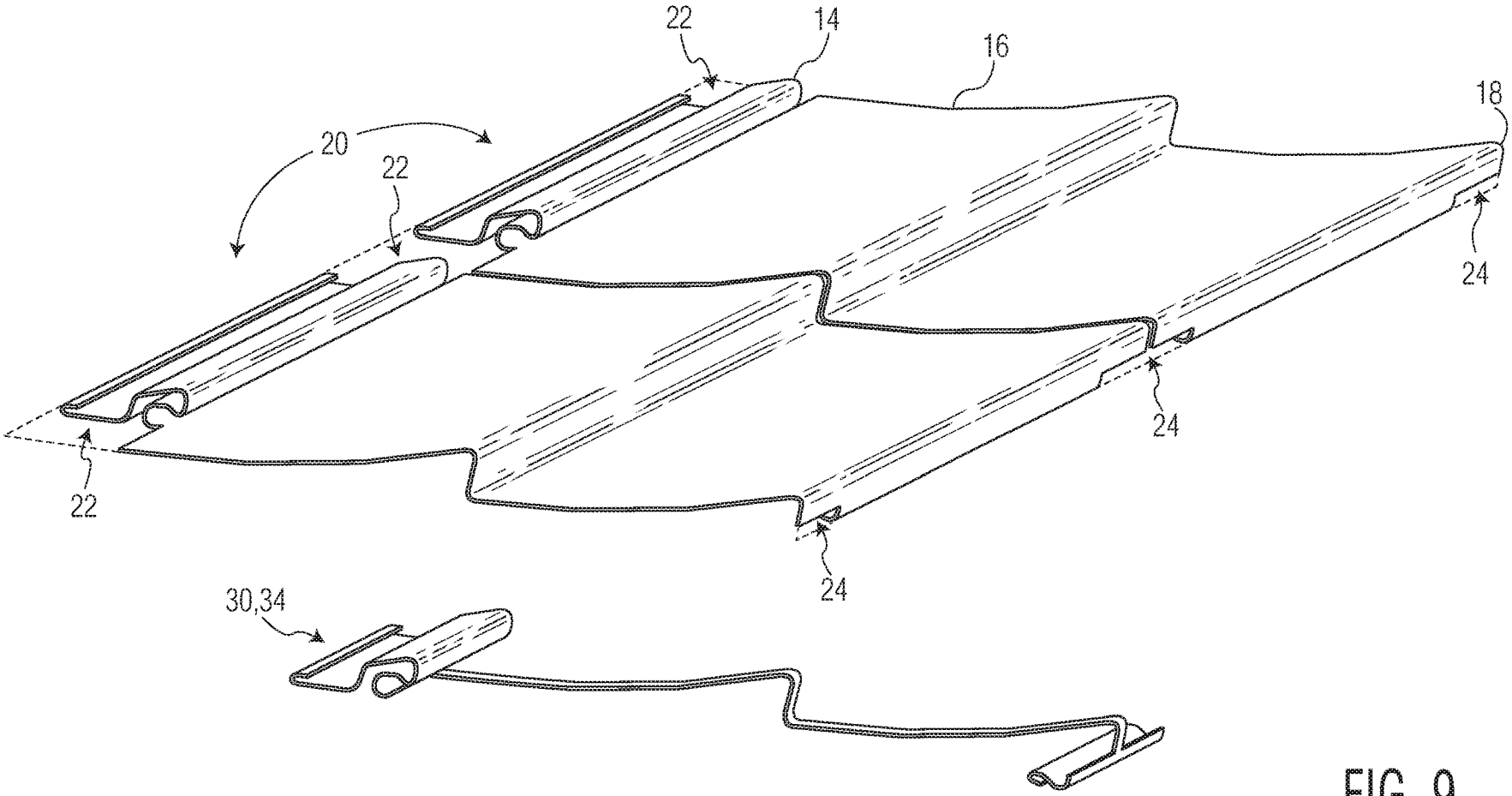
FIG. 9 is a perspective view of the piece of notched siding with a cutting waste produced by the siding cutting tool.

As shown in FIG. 9, the siding cutting tool 1 produces the same finished pieces of notched siding 20 as shown in FIG. 2, but the siding cutting tool 1 produces a cutting waste 30 as a single and integral scrap slug 34. The precise shape of the scrap slug 34 shown in FIG. 9 is merely exemplary as the shape of the scrap slug 34 will necessarily vary according to the shape of the crude siding 10. The siding cutting tool 1, as described above, uses an angular motion of the top cam plate 610 to cut the top lock 14 in a single motion; a single movement of the upper plate 100 along the vertical direction V from the open position O to the closed position C cuts the nail hem 12, the top lock 14, the bottom lock 18, and separates faces 16 of the pieces of notched siding 20. Further, the notch cutters 620 that cut the top lock 14 do not contact the face 16 of the crude siding 10 and therefore do not damage the face 16 of the crude siding 10. Additionally, the integral scrap slug 34 produced by the siding cutting tool 1 exits the base 200 in the vertical direction V through the waste chute 230 shown in FIG. 4. The siding cutting tool 1 consequently both produces fewer pieces of waste 30 than the prior art and also discharges the waste 30 in a controlled manner to contain debris.

What is claimed is:

1. A siding cutting tool, comprising:

an upper plate;

a base, the upper plate movable with respect to the base along a vertical direction;

a siding support assembly attached to the base and adapted to support a piece of crude siding having a top lock with a bent or rolled over shape; and a top notch cutting assembly including a top cam plate, a plurality of notch cutters attached to the top cam plate, a plurality of top rollers disposed in the top cam plate, and a plurality of top cam bars extending through the top cam plate, the top cam plate moving along a top cam plate direction extending at an acute angle with respect to the vertical direction and the notch cutters cutting the top lock along the top cam plate direction as the upper plate moves toward the base along the vertical direction, the top cam bars each have a central section extending at an angle with respect to the vertical direction and contacting the top rollers as the upper plate moves toward the base to move the top cam plate in the top cam plate direction.

2. The siding cutting tool of claim 1, further comprising a bottom notch cutting assembly including a bottom cam plate and a plurality of bottom cutters attached to the bottom cam plate.

3. The siding cutting tool of claim 2, wherein the bottom cam plate moves along a longitudinal direction perpendicular to the vertical direction as the upper plate moves toward the base and the bottom cutters cut a bottom lock of the piece of crude siding opposite the top lock.

4. The siding cutting tool of claim 3, further comprising a blade attached to the upper plate.

5. The siding cutting tool of claim 4, wherein the blade moves along the vertical direction as the upper plate moves toward the base and cuts an entire length of the piece of crude siding along the longitudinal direction.

6. The siding cutting tool of claim 5, wherein the top notch cutting assembly, the bottom notch cutting assembly, and the blade produce a cutting waste cut from the piece of crude siding that is a single and integral scrap slug.

7. The siding cutting tool of claim 6, wherein the base has a waste chute extending through the base along the vertical direction.

8. The siding cutting tool of claim 7, wherein the single and integral scrap slug exits the base in the vertical direction through the waste chute.

9. The siding cutting tool of claim 1, wherein the top cam bars each have an upper section attached to the upper plate, the central section extending from the upper section, and a lower section extending from the central section in the vertical direction.

10. The siding cutting tool of claim 3, wherein the bottom notch cutting assembly includes a plurality of bottom rollers disposed in the bottom cam plate and a bottom cam bar extending through the bottom cam plate.

11. The siding cutting tool of claim 10, wherein the bottom cam bar has an upper section, a central section extending from the upper section at an angle with respect to the vertical direction, and a lower section extending from the central section in the vertical direction.

12. The siding cutting tool of claim 11, wherein the central section of the bottom cam bar contacts the bottom rollers as the upper plate moves toward the base to move the bottom cam plate in the longitudinal direction.

13. The siding cutting tool of claim 4, wherein the blade has a contoured side with a contoured shape adapted to the piece of crude siding.

14. The siding cutting tool of claim 4, wherein the blade passes through a blade passageway of the top cam plate and a blade passageway of a bottom cam housing of the bottom notch cutting assembly as the upper plate moves toward the base along the vertical direction.

15. The siding cutting tool of claim 13, wherein the siding support assembly has a shear plate on which the piece of crude siding is disposed and a pair of anvils extending over a top end of the shear plate.

16. The siding cutting tool of claim 15, wherein the contoured side of the blade extends into a shear plate passageway of the shear plate as the upper plate moves toward the base along the longitudinal direction.

17. The siding cutting tool of claim 15, wherein each of the anvils has a cantilevered anvil portion with an anvil contoured surface matching a shape of a nail hem and the top lock of the piece of crude siding.

18. The siding cutting tool of claim 15, wherein the top cam plate is positioned between the anvils and moves with respect to the anvils along the top cam plate direction.

* * * * *